United States Patent [19]

Coburn

[11] 4,059,474

[45] Nov. 22, 1977

[54] GLUE MECHANISM

[75] Inventor: Robert E. Coburn, Warminster, Pa.

[73] Assignee: Molins Machine Company Inc., Cherry Hill, N.J.

[21] Appl. No.: 684,607

[22] Filed: May 10, 1976

[51] Int. Cl.[2] ..... B05C 1/08; B31F 1/28

[52] U.S. Cl. ..... 156/356; 118/8; 118/249; 156/462; 156/578

[58] Field of Search ..... 118/249, 8, 262, 258, 118/249, 259, 234, 44, 421, 241; 101/364; 156/356, 462, 578; 134/117

[56] References Cited

U.S. PATENT DOCUMENTS

| | | | |
|---|---|---|---|
| 2,589,966 | 3/1952 | Rullo | 118/249 |
| 2,661,716 | 12/1953 | Minkow | 118/262 |
| 3,093,051 | 6/1963 | Ritzerfeld et al. | 118/421 X |
| 3,220,377 | 11/1965 | Good | 118/8 |
| 3,712,185 | 1/1973 | Falasconi et al. | 118/262 X |

*Primary Examiner*—John P. McIntosh
*Attorney, Agent, or Firm*—Seidel, Gonda & Goldhammer

[57] ABSTRACT

A pan and an applicator roller supported thereby are pivotably supported for movement between operative and inoperative positions by a parallelogram link means including a gear segment. Actuator means is connected to the gear segment for rotating the same in opposite directions.

15 Claims, 2 Drawing Figures

FIG. 1
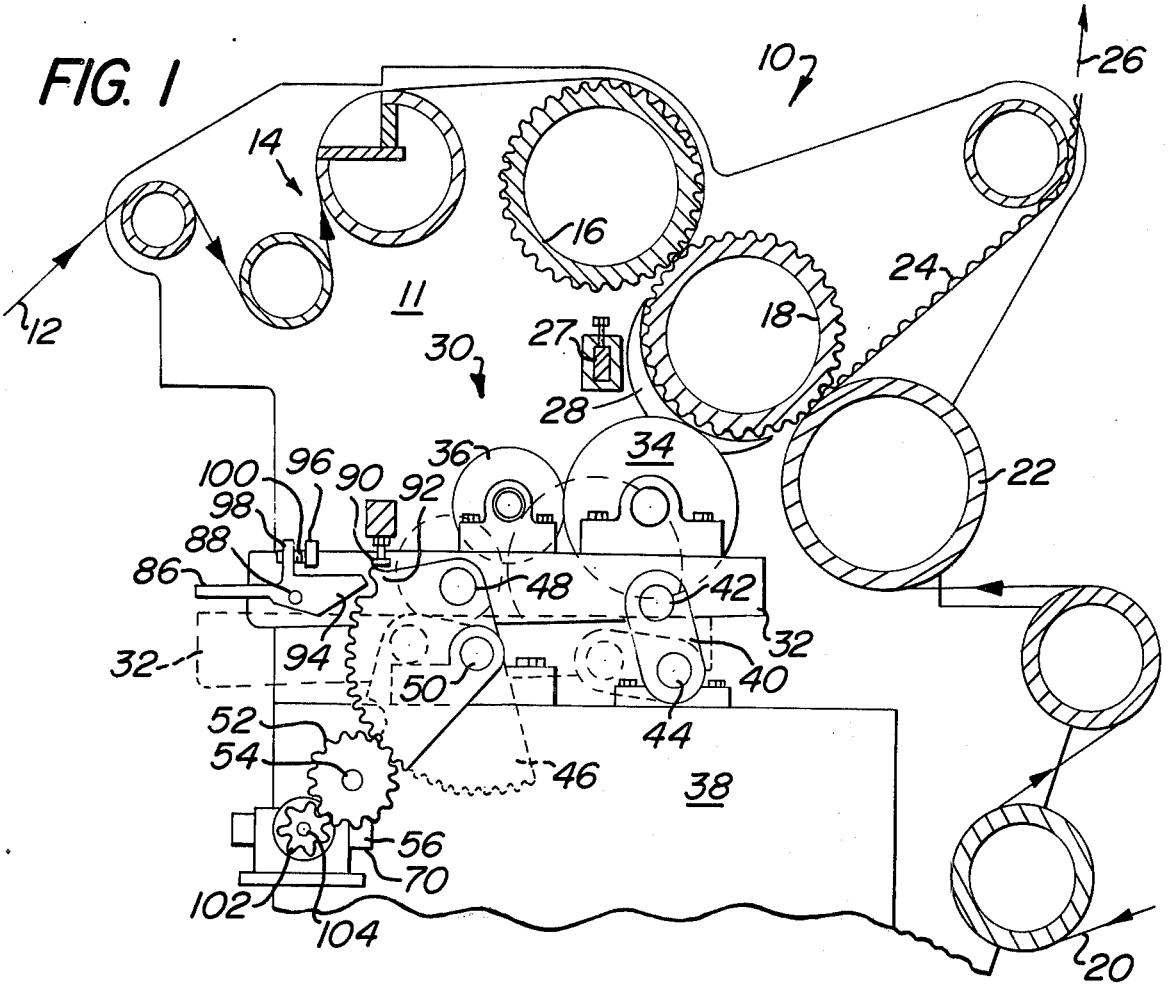
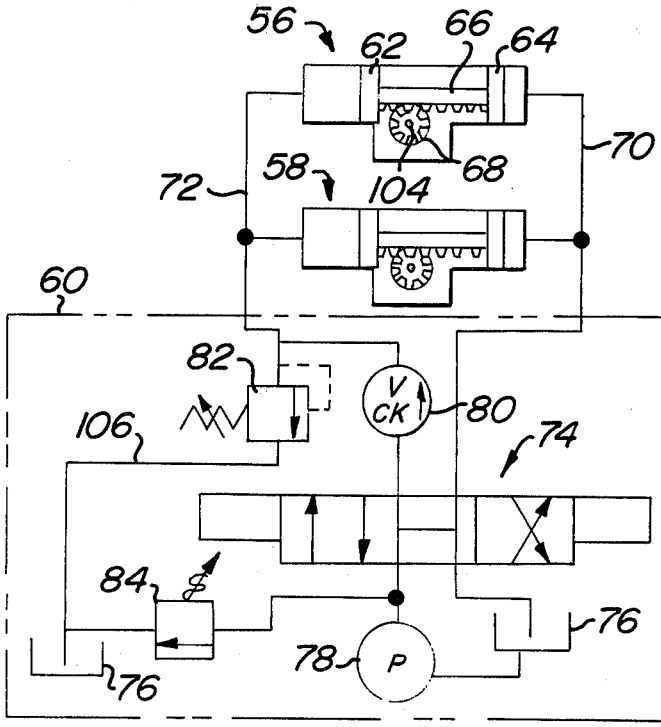
FIG. 2

GLUE MECHANISM

FIELD OF THE INVENTION

This invention relates generally to the manufacture of corrugated paperboard and more specifically to the supporting mechanism of the applicator roll for applying an adhesive bonding agent to the crests of the corrugated medium in a single facer machine.

BACKGROUND

In the manufacture of single face corrugated paperboard, a paper medium web is corrugated between two fluted corrugating rolls. Then the corrugated medium is retained on one of the corrugating rolls as it is moved past a rotating adhesive applicator roller. The applicator roller is positioned close to the fluted corrugating roll so that an adhesive bonding agent on the surface of the roller may be readily transferred to the crests of the fluted medium. The medium is then bonded to a web of liner board in the nip between one of the corrugating rolls and a juxtaposed pressure roll.

The corrugating and pressure rolls are heated generally with steam to a temperaturee of approximately 350° to facilitate corrugating the medium and to effect bonding by the adhesive bonding agent. The adhesive bonding agent is generally a partially cooked solution of starch which gels to form an adhesive when exposed to heat.

From time to time, it is necessary to change the corrugating medium or to temporarily stop the single facer. If the adhesive applicator roller were allowed to remain in close proximity to the corrugating roll with no medium between them, the adhesive on the surface of the applicator roller would be quickly gelled, causing an accumulation of matter which would ruin the adhesive supply and contaminate the surface of the corrugating roll. Conventionally, therefore, the adhesive applicator roller is moved away from the corrugating roll whenever the single facer stops consuming medium.

Since high precision is required in positioning the adhesive applicator roller, the mechanism for elevating and lowering the roller is both massive and complicated. The weight of the massive roller further compounds the problem.

Heretofore, the mechanism for raising and lowering the adhesive applicator roller was actuated through a complex arrangement of links and an air-oil circuit. This type circuit was necessary to provide the smooth operation required. One disadvantage of that mechanism was that no self-actuating emergency release of the pressure could be readily incorporated to lower the adhesive roller to its inoperative position in the event of an accidental wrap of corrugating medium around the corrugating roll. An accidental wrap occurs if the medium web is accidentally ruptured. If an accidental wrap occurred the machine was invariably damaged. Consequently, there has been a need for a system to provide positive support for the applicator roll and be self-releasing in the event of a wrap-up of material on the periphery of a corrugating roll.

SUMMARY OF THE INVENTION

The mechanism of the present invention includes a pan adapted to contain the liquid adhesive bonding agent. A support structure pivotably supports the pan and the applicator roller thereon by parallelogram link means so that the pan and roller may pivot between operative and inoperative positions. The link means includes a gear segment. An actuator means is coupled to the gear segment for rotating the gear segment in opposite directions.

The glue mechanism of the present invention includes means for sensing a pressure build-up between the corrugating roll and the applicator roll. When the pressure exceeds a predetermined amount, the glue mechanism is automatically moved to a position to thereby prevent damage to the applicator roll as well as to avoid the consequent down time that would be encountered. Another advantage of the present invention is the use of fewer and less expensive parts or components to attain movement of the glue mechanism between its operative and inoperative positions.

It is an object of the present invention to provide a novel glue mechanism.

It is another object of the present invention to provide a glue mechanism which automatically moves toward an inoperative position if pressure builds up between the corrugating roll and the applicator roll beyond a predetermined level.

It is another object of the present invention to provide a glue mechanism using fewer and less expensive components while being more reliable and requiring less maintenance.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a diagrammatic sectional view of a single facer machine incorporating the glue mechanism of the present invention.

FIG. 2 is a diagrammatic circuit diagram for operating the glue mechanism.

Referring to the drawing in detail, wherein like numerals indicate like elements, there is shown in FIG. 1 a single facer machine designated generally as 10. The single facer machine 10 includes frames 11 on opposite sides thereof which support conventional guide members 14 for guiding a medium web 2 to the corrugating rolls 16 and 18. A liner 20 extends around guide rolls and a pressure roll 22.

The pressure roll 22 is adjacent to the lower corrugating roll 18 so that web 12 may be joined to liner 20 to form corrugated single face paperboard web 24. Web 24 exits from the single facer 10 in the direction of arrow 26 to a bridge between the single facer machine 10 and a double facer machine not shown.

A plurality of crescent-shaped fingers 28 are juxtaposed to the outer periphery of a portion of corrugating roll 18 to retain the corrugatd medium web 12 in the flutes of the corrugating roll 18. The fingers 28 are mounted on a support member 27 extending transversely across the single facer machine 10. A glue mechanism 30 is provided for applying an adhesive bonding agent to the crests of the flutes of that portion of web 12 on the corrugating roll 18. Mechanism 30 includes an applicator roll 34 and a doctor roll 36 rotatably supported by the pan 32. Roll 34 has a plurality of grooves for receiving a portion of the fingers 28.

The pan 32 contains a liquid which is preferably a starch bonding agent which becomes an adhesive when gelatinized by increasing its temperature in a conventional manner. Pan 32 is movable, along with rolls 34 and 36, between the operative position shown and an inoperative position illustrated in phantom in FIG. 1. An actuator means is provided for moving the mechanism 30 between operative and inoperative positions.

Pan 32 is supported by a discrete parallelogram linkage on opposite ends thereof. Since each linkage is identical, only the linkage on one end will be described. One of the elements of the parallelogram linkage is link 40. Link 40 is pivotably connected to the base 38 of the single facer machine 10 at pin 44 and is pivotably connected to the pan 32 by pin 42.

The other element of the parallelogram linkage is segment gear 46. Segment gear 46 is pivotably connected to the base 38 by pin 50. Segment gear 46 is also pivotably connected to the pan 32 by pin 48.

The segment gear 46 is meshed with a pinion 52 on shaft 54. Shaft 54 extends transversely across the single facer machine 10. Rotation of shaft 54 causes pinion 52 to rotate segment gear 46. The means for selectively rotating shaft 54 is shown in FIG. 2.

A rotary actuator 56 is coupled to pinion 52 on one end of shaft 54 by meshing pinion 102. Rotary actuator 58 is similarly coupled to the opposite end of shaft 54. The rotary actuators 56 and 58 are identical. Only actuator 56 will be described in detail.

The rotary actuator 56 includes a cylinder having a pair of pistons 62 and 64 interconnected by a rack 66. The rack 66 is meshed with a pinion 68 on the stud shaft 104. Stud shaft 104 supports pinion 102 which meshes with pinion 52. Circuitry 60 is provided at one end of machine 10 for controlling actuators 56 and 58. A hydraulic motive liquid from circuity 60 is introduced into opposite ends of the cylinders by way of conduits 70 and 72. The actuators 56 and 58 are coupled to the conduits 70 and 72 in parallel.

Conduit 70 communicates with the pump 78 or the reservoir 76 depending on the position of solenoid operated valve 74. Valve 74 is in its neutral position as shown. Conduit 72 communicates with the pump 78 or reservoir 76 depending on the position of valve 74. Between actuator 58 and reservoir 76, conduit 72 includes a check valve 80 and counter-balance control valve 82 in parallel. Between pump 78 and valve 74, conduit 72 communicates with the reservoir 76 by way of a pressure relief valve 84. The actuators 56, 58 and the circuitry 60 constitute a closed system containing a small amount of hydraulic liquid on the order of about 3 quarts.

An adjustable limit stop 90 is mounted on frame 11 to engage extension 92 of segment gear 46. By limiting the clockwise rotation in FIG. 1 of segment gear 46, limit stop 90 establishes the clearance between the periphery of applicator roll 34 and the periphery of corrugating roll 18.

Manual release lever 86 includes a dog 94 which is adapted to engage segment gear 46. When mechanism 30 is in the operative position, dog 94 is received in an open area of segment gear 46 below extension 92 as shown in FIG. 1. A limit stop 96 is mounted on frame 11 in a position to restrict clockwise rotation of lever 86 about pin 88. Lever 86 includes finger 98 having an adjustable member 100 which can be positioned to fix the limit for the clockwise rotation in FIG. 1 of lever 86.

The dog 94 on manual release lever 86 is set with clearance of about ⅛ inch between its surface and the extension 92 of gear segment 46. When the glue mechanism retracts to its intermediate mode position, counterclockwise rotation of gear segment 46 is thereby limited to the preset clearance between extension 92 and the dog 94.

The operation is as follows.

The apparatus of the present invention has three positions. In FIGS. 1 and 2, the glue mechanism 30 is in the operative position. The mechanism 30 may be moved to the phantom position in FIG. 1 corresponding to its inoperative position for purposes of cleaning the components. Also, the glue mechanism 30 has an intermediate position wherein the applicator roll 34 is retracted from the corrugating roll 18 for a short distance of approximately ⅛ to ¼ inch whenever the single facer machine 10 stops or in the event or a wrap-up. The grooves on the application roll 34 still retain the crescent fingers 28 at said intermediate position of the application roll 34. Hence, the position of the fingers 28 is not disturbed.

In FIG. 2, the valve 74 is in a neutral position. When it is desired to move the glue mechanism 30 to an inoperative position for cleaning the pan and the rolls 34, 36, the release lever 86 is rotated counterclockwise in FIG. 1 to permit gear segment 46 to rotate counterclockwise, and the valve 74 is shifted from right to left in FIG. 2. Pump 78 pumps a hydraulic liquid such as oil through conduit 70 to each of the cylinders of actuators 56, 58 to thereby reciprocate the pistons and racks therein to effect clockwise rotation of shaft 54 in FIG. 1. Such rotation of shaft 54, by way of pinion 52, rotates the gear segment 46 about pin 50 in a counterclockwise direction in FIG. 1 to move the glue mechanism 3 to the phantom position of pan 32 while maintaining the same horizontal at all times. The hydraulic liquid that is displaced by movement of the pistons causes valve 82 to open whereby the liquid is returned to the reservoir 76 by way of conduits 72 and 106. Movement of the mechanism 30 from its operative to its inoperative position is rapid and smooth.

If the web 12 becomes jammed between the corrugator roll 18 and the applicator roll 34, the accumulation of paper web on the roll periphery exerts pressure which is likely to cause damage. The increased radial pressure on the applicator roll 34 moves the glue mechanism 30 toward its inoperative position and rotates shaft 54 thereby applying pressure by way of the pistons to the hydraulic liquid in conduit 72. When the pressure of the liquid in conduit 72 overcomes the force of the spring bias on valve 82, valve 82 is shifted to a dump position wherein the liquid is returned through conduit 106 to the reservoir 76. As a result thereof, the glue mechanism 30 pivots to its intermediate position.

When the glue mechanism 30 is being moved from its operative to its inoperative position, there is a tendency for the mechanism 30 to move rapidly as it approaches its inoperative position. Valve 82 acts as a counterbalance valve and slows the movement of the mechanism 30 so as to provide smooth controlled rate of movement thereof.

Upon start-up of single facer 10, the application of electric current to the drive motor is sensed and a signal directed to the appropriate solenoid of solenoid operated valve 74. In this instance, valve 74 shifts to the left hand position in FIG. 2 directing motive fluid to piston 62. As previously explained, gear segment 46 moves in a clockwise direction in FIG. 1 elevating the glue mechanism 30 from its intermediate position to the operative position set by adjustable stop 90.

When it is desired to stop single factor 10, electric current is removed from the drive motor. This is sensed by means well known in the art, causing valve 74 to shift to the right hand position in FIG. 2. Motive fluid is then applied to piston 64 causing the mechanism 30 to lower to the intermediate position fixed by contact between dog 94 of lever 86 and extension 92. The pressure required in line 72 to support mechanism 30 is approximately 100–150 psi, depending on the mass of the supported machined components. Pressure control valve 82 is preset to open at a suitable higher pressure of approximately 250–300 psi.

The present invention may be embodied in other specific forms without departing from the spirit or essential attributes thereof and, accordingly, reference should be made to the appended claims, rather than to the foregoing specification as indicating the scope of the invention.

I claim:

1. A mechanism for applying a liquid to a moving web comprising a pan for containing a supply of the liquid, a support structure pivotably supporting said pan by a parallelogram link means on opposite ends of the pan for movement between operative and inoperative positions, each of said link means including a discrete segment gear and a link, and actuator means including a shaft below the elevation of said mechanism, a pair of pinions on said shaft for rotation therewith, each pinion being meshed with a discrete segment gear on opposite ends of the pan for simultaneously rotating said discrete segment gears to thereby move said pan between its operative and inoperative positions.

2. A mechanism in accordance with claim 1 wherein said actuator means includes a hydraulic circuit having a counterbalance control valve for dumping the hydraulic liquid to a reservoir when the mechanism is subjected to forces above a predetermined amount.

3. A mechanism in accordance with claim 2 including a discrete hydraulic rotary actuator coupled to each end of said shaft for simultaneous rotation of said shaft through a predetermined arc.

4. A mechanism in accordance with claim 1 including a manual release lever meshed with a portion of one of the discrete segment gears.

5. Apparatus in accordance with claim 1 including means defining an intermediate position for said mechanism and for causing said mechanism to automatically move to the intermediate position when abnormal force is exerted on said mechanism.

6. In a single facer machine having a pair of meshed corrugated rolls and a pressure roll juxtaposed to one of the corrugating rolls, a mechanism including an applicator roll for applying an adhesive bonding agent to the crests of fluted medium on one of said pair of corrugating rolls, said mechanism including a pan supporting said applicator roll and mounted for movement therewith between operative and inoperative positions, the improvement comprising a parallelogram link means on opposite ends of the pan, each of said link means including a link and a discrete segment gear, and actuator means coupled to each discrete segment gear for rotating the discrete segment gears simultaneously to thereby move the glue mechanism between its operative and inoperative positions.

7. A machine in accordance with claim 6 wherein said actuator means includes a closed hydraulic circuit having a counterbalance control valve for dumping hydraulic liquid to a reservoir when the mechanism is subjected to forces above a predetermined amount.

8. A machine in accordance with claim 7 including a shaft below the elevation of said mechanism, a pair of pinions on said shaft for rotation therewith, each end of said shaft supporting one pinion of said pair, each pinion being meshed with a discrete segment gear on opposite sides of the pan, and a discrete hydraulic rotary acutator coupled to each of said pinions for simultaneous rotation of said shaft through a predetermined arc.

9. A machine in accordance with claim 8 wherein each hydraulic actuator includes a cylinder, a pair of pistons interconnected by a rack for reciprocation within said cylinder, said rack meshing with a first pinion supported by a stud shaft for rotation therewith, and said stud shaft being coupled to a second pinion meshing with one of said pair of pinions.

10. A machine in accordance with claim 9 wherein said counterbalance control valve is interposed in said closed hydraulic circuit between said reservoir and one end of each cylinder.

11. A machine in accordance with claim 6 including means for automatically moving said mechanism to an intermedite position when the mechanism is subjected to abnormal force due to a web wrap up on one of said corrugating rolls.

12. A machine in accordance with claim 11 wherein said last mentioned means also moves said mechanism to said intermediate position when said machine stops.

13. A machine in accordance with claim 6 wherein each segment gear includes an extension on the periphery of its gear teeth, means mounted in the path of rotation of said extension for limiting the clockwise rotary movement of said segment gears for fixing the clearance between the periphery of said applicator roll and the periphery of an adjacent corrugating roll.

14. A machine in accordance with claim 13 including means for stopping the counterclockwise rotation of said segment gears at an intermediate position of said pan, and said stopping means cooperating with said extensions for stopping the counterclockwise rotation of said segment gears at said intermediate position, and said stopping means being retractable to allow further counterclockwise rotation of said segment gears to the inoperative position of said pan.

15. A mechanism for applying a liquid to a moving web comprising:

a pan for containing a supply of the liquid;

a support structure pivotably supporting said pan by a pair of parallelogram link means on opposite ends of said pan for movement between operative and inoperative positions, each of said link means including a discrete segment gear;

actuator means coupled to each of said segment gears for simultaneously rotating each of said segment gears to thereby move said pan between operative and inoperative positions; and said actuator means including a hydraulic circuit having a counterbalance valve sensitive to forces on said mechanism above a predetermined amount for dumping pressurized hydraulic liquid to a reservoir when said mechanism is subjected to forces above the predetermined amount.

* * * * *